US008172611B1

(12) United States Patent
Montena

(10) Patent No.: US 8,172,611 B1
(45) Date of Patent: May 8, 2012

(54) METHOD AND ASSEMBLY FOR CONNECTING A COAXIAL CABLE END TO A THREADED PORT

(75) Inventor: Noah P. Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 16 days.

(21) Appl. No.: 12/911,841

(22) Filed: Oct. 26, 2010

(51) Int. Cl.
*H01R 9/05* (2006.01)

(52) U.S. Cl. ..... 439/578

(58) Field of Classification Search ..... 439/578, 439/583–585, 580
See application file for complete search history.

(56) References Cited

U.S. PATENT DOCUMENTS

| | | | | |
|---|---|---|---|---|
| 3,517,371 | A | 6/1970 | Buckley | |
| 3,953,097 | A | 4/1976 | Graham | |
| 4,053,195 | A | 10/1977 | Laverick et al. | |
| 4,484,790 | A | 11/1984 | Schildkraut et al. | |
| 4,508,406 | A | 4/1985 | Brush, Sr. et al. | |
| 4,534,607 | A | 8/1985 | Tomsa | |
| 4,548,458 | A | 10/1985 | Gallusser et al. | |
| 4,806,116 | A | 2/1989 | Ackerman | |
| 4,824,386 | A | 4/1989 | Souders | |
| 4,902,238 | A | 2/1990 | Iacobucci | |
| 5,564,938 | A | 10/1996 | Shenkal et al. | |
| 5,723,818 | A | 3/1998 | Yeh | |
| 6,152,753 | A | 11/2000 | Johnson et al. | |
| 6,153,830 | A * | 11/2000 | Montena | 174/88 C |
| 6,491,546 | B1 | 12/2002 | Perry | |
| 6,848,920 | B2 | 2/2005 | Fox | |
| 7,033,195 | B2 | 4/2006 | Murphy et al. | |
| 7,086,876 | B1 | 8/2006 | Montena | |

* cited by examiner

*Primary Examiner* — Javaid Nasri
(74) *Attorney, Agent, or Firm* — Schmeiser Olsen & Watts

(57) ABSTRACT

An assembly for connecting a coaxial cable end to a threaded port and having a fitting to which an end of a coaxial cable can be connected. A nut, joined to the fitting, has a first set of threads and is turnable in a tightening direction around a central axis of the connecting assembly to progressively engage the first set of threads with a second set of threads on a port. The nut has an outer surface at which a first edge, facing circumferentially in a first direction, is defined. A sleeve surrounds the nut and has a body with a first reconfigurable finger extending in a circumferential direction and upon which a second edge, facing circumferentially oppositely to the first direction, is defined. The second edge is brought into bearing engagement with the first edge as the sleeve is turned in the tightening direction around the central axis so that the nut follows movement of the sleeve. The sleeve is movable continuously relative to the nut around the central axis in a loosening direction.

22 Claims, 8 Drawing Sheets

METHOD AND ASSEMBLY FOR CONNECTING A COAXIAL CABLE END TO A THREADED PORT

BACKGROUND OF THE INVENTION

1. Field of the Invention

This invention relates to connectors for coaxial cable and, more particularly, to a method and assembly for connecting a coaxial cable end to a threaded port so as to avoid unauthorized separation of the cable end from the port.

2. Background Art

Coaxial cable is used in cable television systems (CATV), subscription television systems (STV), and master antenna television systems (MATV). It is common to connect coaxial cable ends in these systems using threaded connectors at a splice or drop location. To avoid unauthorized separation of a coaxial cable end, as might permit diversion of a cable signal, tamper-resistant shielding assemblies have been devised and are commonly incorporated at such locations.

To deter such tampering at CATV connections, in places such as hotels, dormitories, public areas, or even in a subscriber's home, security shields have been installed over connectors at ports. While these shields are relatively inexpensive and reasonably effective in preventing tampering, they are often inconvenient and cumbersome to employ. The shields are commonly made as assemblies that are separate from the connectors and typically require that a customized security wrench be used to tighten the connector, within a component on the shield, onto a port.

A shield assembly that is inconvenient or difficult to install may be the cause of a number of problems. The requirement of a dedicated tool for installation introduces its own set of problems. An installer will typically have to controllably direct the tool into operative engagement with a threaded nut to effect assembly. This may be a difficult process, particularly when installations are carried out in cold conditions that may warrant the wearing of gloves that interfere with manipulation of the connector parts, tools, and shield assembly.

By imparting the assembly torque through a special tool, an installer may not get a proper feel for the applied torque. This may result in either overtightening or undertightening of connector parts. The former may necessitate a reconnection. If parts are destroyed during assembly and this condition is not detected, improper connections may result that may compromise signal transmission or, in a worst case, lead to a signal failure. Undertightening may likewise lead to a compromised signal transmission.

Failed installation has a number of economic consequences. Subscribers may equate an improper installation with inferior service that may prompt a change in providers. Alternatively, improper installations may necessitate return visits. If these problems occur in significant numbers, the economic impact could be significant, particularly given that installation margins are relatively small, given the competitive nature of the cable industry.

Most significantly, the effectiveness of any shielding structure depends upon the consistent use of the same by installers. In an effort to simplify or speed up installations, installers may choose to forego the use of a shield structure altogether. In the event an installer does not have on hand a specialized installation tool required for use in conjunction with the shielding structure, he/she may likewise effect installations without any shielding components. This leads to a vulnerable connection that may again have significant economic consequences should services be pirated at such locations.

The industry continues to seek out designs of shielding structures that will be consistently used, reliably and consistently installed, and effective in terms of both facilitating the establishment of high quality connections and avoiding unauthorized separation of connectors at locations where signals might be unlawfully diverted.

SUMMARY OF THE INVENTION

In one form of the invention, an assembly is provided for connecting a coaxial cable end to a threaded port. The connecting assembly has a fitting to which an end of a coaxial cable can be connected. A nut, joined to the fitting, has a first set of threads and is turnable in a tightening direction around a central axis of the connecting assembly to progressively engage the first set of threads with a second set of threads on a port. The nut has an outer surface at which a first edge, facing circumferentially in a first direction, is defined. A sleeve surrounds the nut and has a body with a first reconfigurable finger extending in a circumferential direction and upon which a second edge, facing circumferentially oppositely to the first direction, is defined. The second edge is brought into bearing engagement with the first edge as the sleeve is turned in the tightening direction around the central axis so that the nut follows movement of the sleeve to secure the nut to a port. The sleeve is movable continuously relative to the nut around central axis in a loosening direction that is opposite to the tightening direction.

In one form, the first finger is movable as one piece with the sleeve body.

In one form, the first finger is struck from an annular component and projects in cantilever fashion to the second edge.

In one form, the nut has first and second axially spaced surface portions, with the first edge defined on the first surface portion. The second surface portion has a plurality of flats arranged to be operatively engaged by a conventional wrench through relative radial movement between the wrench and nut in such a manner that spaced surfaces on the wrench simultaneously engage at least two of the flats on the nut in a manner whereby the wrench can be manipulated to turn the nut around the central axis.

In one form, the sleeve has an axial extent and is configured so that the sleeve blocks radial movement of a conventional wrench into operative engagement with the nut.

In one form, the first and second edges engage over a substantial axial extent so that there is positive torque transmission effected by the sleeve from the second edge to the nut through the first edge.

In one form, there is at least one other edge on the nut that is circumferentially spaced from the first edge and cooperates with the second edge in a manner that is substantially the same as a manner in which the first edge cooperates with the second edge.

In one form, there is at least one other reconfigurable finger on the sleeve that is circumferentially spaced from the first finger and cooperates with the first edge in a manner that is substantially the same as a manner in which the first finger cooperates with the first edge.

In one form, the sleeve has an outer surface that is textured to facilitate grasping and turning of the sleeve by a hand of a user.

In one form, the connecting assembly is provided in combination with a tool that can be directed axially relative to the connecting assembly into keyed engagement with the nut, whereupon the tool can be manipulated to turn the nut around the central axis to release the nut from a port with which the nut is threadably engaged.

In one form, the connecting assembly has axially spaced first and second ends. The fitting is at the first end of the connecting assembly, with the nut at the second end of the connecting assembly. The tool is directed into keyed engagement with the nut by movement from an initial axial spaced position in an axial direction from the first end toward the second end.

In one form, the connecting assembly has axially spaced first and second ends. The fitting is at the first end of the connecting assembly, with the nut at the second end of the connecting assembly. The tool is directed into keyed engagement with the nut by movement from an initial axially spaced position in an axial direction from the second end toward the first end.

In one form, the nut has an outer surface extent that increases in diameter in a circumferential direction progressively toward the first edge so that the first finger is progressively cammed radially outwardly by the outer surface extent as the second edge circumferentially approaches the first edge as the sleeve is moved relative to the nut in the loosening direction.

In one form, the first finger has a cantilevered configuration and is reconfigured primarily by bending in a radial direction as the second edge moves circumferentially up to and past the first edge as the sleeve is moved relative to the nut in the loosening direction.

In one form, the first finger has an attaching end and a curved surface that is concave opening radially inwardly substantially fully between the attaching end and second edge.

In one form, the sleeve has an axial extent sufficient to surround substantially an entire axial extent of the nut and at least a majority of an axial extent of the fitting.

In another form of the invention, an assembly is provided for connecting a coaxial cable end to a threaded port. The assembly has a fitting structure for connection to an end of a coaxial cable. A threaded nut is joined to the fitting structure and turnable in a tightening direction around a central axis of the connecting assembly to progressively threadably engage the nut with a port. A sleeve surrounds the nut. A first edge structure on the nut and a second edge structure on the sleeve cooperate to: a) be brought into bearing engagement as the sleeve is turned in the tightening direction around the central axis so that the nut follows movement of the sleeve around the central axis; and b) allow the sleeve to be moved continuously relative to the nut around the central axis in a loosening direction that is opposite to the tightening direction.

In one form, the sleeve has an axial extent and is configured so that the sleeve blocks radial movement of a conventional wrench into operative engagement with the nut.

In one form, the connecting assembly is provided in combination with a tool that can be directed axially relative to the connecting assembly into keyed engagement with the nut, whereupon the tool can be manipulated to turn the nut around the central axis to release the nut from a port with which the nut is threadably engaged.

In yet another form of the invention, a method is provided for connecting a coaxial cable end to a threaded port. A connecting assembly is provided and has a central axis. The connecting assembly includes a fitting, a threaded nut joined to the fitting and having a first circumferentially facing edge, and a sleeve surrounding the nut and at least a part of the fitting and defining a second circumferentially facing edge. One of the edges is defined by a finger that extends circumferentially and is reconfigurable to vary a radial position of the one edge. The coaxial cable end is connected to the fitting. Threads on the nut are mated with threads on the port. The sleeve is turned in a tightening direction around the central axis and thereby causes the edges to interact so that: a) the second edge bears against the first edge to thereby cause the nut to follow movement of the sleeve around the central axis; and b) the second edge can move past the first edge in the event the sleeve is turned continuously around the central axis in a loosening direction that is opposite to the tightening direction.

In one form, the connecting assembly includes a sleeve that has an axial extent sufficient to surround substantially an entire axial extent of the nut and at least a majority of an axial extent of the fitting.

In one form, the connecting method further includes a tool, directing the tool from an initial axial spaced position in an axial direction into keyed engagement with the nut, and through manipulation of the tool effecting turning of the nut around the central axis in a loosening direction.

DETAILED DESCRIPTION OF THE PREFERRED EMBODIMENT

Figure 1:
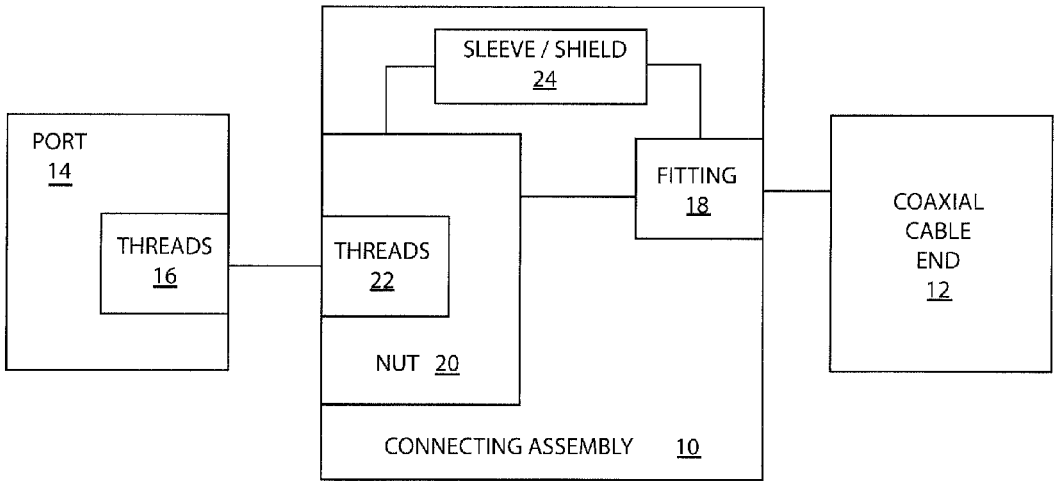
FIG. 1 is a schematic representation of an assembly for connecting a coaxial cable end to a threaded port, according to the invention.

In FIG. 1, an assembly is shown at 10 for connecting a coaxial cable end 12 to a port 14 with threads 16. The connecting assembly 10 has a fitting 18 to which the coaxial cable end 12 is connected. A nut 20 is joined to the fitting 18 and has threads 22 that are engageable with the threads 16 on the port 14. A sleeve/shield 24 extends around the nut 20 and fitting 18.

The components in FIG. 1 are shown schematically to encompass virtually a limitless number of different variations thereof within the inventive concept. For example, the structure for electrically/mechanically joining the coaxial cable end 12 to the fitting 18, and for establishing a conductive path to the port 14, is not limited to any specific construction. Myriad designs currently exist in this industry.

Additionally, the threads 16 on the port 14 will commonly be external threads, with the threads 22 on the nut 20 cooperating internal threads. However, this arrangement can be reversed.

Further, the characterization "threads" is intended to encompass a thread structure that requires continuous relative movement of the sets of threads 16, 22 imparted through several turns around an axis. However, "threads" could likewise encompass connections that require only partial turns, such as bayonet-type connections.

One specific form of the connecting assembly 10 is shown in detail in FIGS. 2-6. It should be understood that this form is exemplary in nature only.

The connecting assembly 10 consists of the aforementioned fitting 18, nut 20, and sleeve/shield 24. The fitting 18 consists of a post 26, a body 28, and a compression ring 30. The fitting 18 is an "EX" type that is just exemplary of the many types of fittings that can be incorporated into the inventive connecting assembly 10. This type of fitting is an axial compression fitting of the type disclosed in U.S. Pat. No. 6,153,830, which is incorporated herein by reference.

With the coaxial cable end 12 operatively attached to the body 28, the compression ring 30 is forcibly shifted axially thereover to secure the cable end 12 to the connecting assembly 10 in a manner whereby center and outer conductors (not shown) are strategically situated to be electrically connected at the port 14.

The nut 20 is operated by being turned around the central axis 32 for the connecting assembly 10. The nut 20 has axially spaced ends 34, 36, with the end 34 surrounding at least a portion of the fitting body 28. The nut 20 has a radially inwardly directed, annular bead 38 that becomes captive axially between an annular shoulder 40 on the fitting post 26 and an axially oppositely facing, annular shoulder 42 on the fitting body 28.

The sleeve/shield 24 has a cylindrically-shaped body 44 extending around an internal receptacle 46 bounded by a stepped-diameter surface 48. The surface 48 consists of a larger diameter portion 50 and a smaller diameter portion 52 between which an annular, radially outwardly offset locking groove 54 is formed.

The body 44 incorporates an annular component 56 having an outturned flange 58 at one axial end 60 thereof and a radially inturned flange 62 at an axial end 64 opposite to the end 60.

An annular bearing 66 has an outer surface 67 with a stepped diameter, with a smaller diameter portion 68 and a larger diameter portion 70.

Preparatory to directing the fitting 18 and nut 20 into the receptacle 46, the bearing 66 is nested into a complementary undercut 72 on the nut 20, whereafter the annular component 56 is slid over the axial end 36 of the nut 20 until the flange 62 abuts to an axially facing, annular surface 80 on the bearing 66, produced at the step between the surfaces 68, 70 thereon.

Preparatory to directing the combined fitting 18, nut 20, annular component 56 and bearing 66 into the receptacle 46, a plastic, split locking ring 82 is extended around the nut 20 in axial alignment with a locking groove 83 thereon. This assembly is then shifted from right to left in FIGS. 2-6 into the receptacle 46 to the fully assembled position shown in FIGS. 3-5. At the point that this position is realized, the flange 62 on the component 56 abuts to an axially facing, annular surface 84, defined by a radially inwardly directed, annular bead 86 at the axial sleeve/shield end 88. In this position, the component flange 58 abuts to an axially facing, annular surface 90, bounding the locking groove 54, and is blocked therein by the locking ring 82, which is initially radially compressed within the locking groove 82 to allow introduction into the receptacle 46. As this registration occurs, the locking ring 82 springs radially outwardly into the groove 54 so as to lock all components together in an assembly state.

Accordingly, the sleeve/shield 24, fitting 18, and nut 20 become a unitary assembly that is used at installation sites. As will be explained below, installation proceeds with the sleeve/shield 24 intact so that installers do not have the option of omitting the sleeve/shield 24 during the assembly process.

The nut 20 has an outer surface 94 with at least a first edge 96 facing circumferentially in a first direction, as indicated by the arrow 98. More preferably, there is a plurality of edges 96', 96", in addition to the first edge 96, that are spaced at regular intervals around the circumference of the outer surface 94. The precise number of the edges 96, 96', 96" is not critical and determines the degree of lost motion as the sleeve/shield 24 is turned around the axis 32, to tighten the nut 20, as hereinafter described. While only three such edges 96, 96', 96" are visible from the perspective of the figures, three additional edges (not shown) are actually provided on the nut 20.

The outer surface 94 has two separate surface portions 100, 102, each with a different configuration. The surface portion 100 has the edges 96, 96', 96" thereon.

The axially spaced surface portion 102 has circumferentially spaced flats 104 that cooperatively produce a polygonal shape that can be engaged by a complementary-shaped tool, as also hereinafter described. As depicted, the flats 104 are arranged to be operatively engaged by a conventional wrench through relative radial movement between the wrench (not shown) and nut 20. While six such flats 104 are depicted, it is only necessary that there be two flats 104 arranged in such a manner that spaced surfaces on a wrench can simultaneously engage the same in a manner whereby the wrench can be manipulated to turn the nut around the axis 32.

The edges 96, 96', 96" are designed to cooperate with at least one, and in this case three, like fingers 106, 106', 106" spaced at equal circumferential distances around the ring-shaped body 108 on the component 56, that is part of the sleeve/shield 24. The component 56 is suitably secured to the body 44 to function as one piece therewith.

In the depicted form, each of the fingers 106, 106', 106" has the same configuration. Exemplary finger 106 is struck directly from the body 108 and extends in a circumferential direction with respect to the axis 32. The finger 106 has a free end 110 that defines an edge 112 that faces circumferentially in a second direction, indicated by the arrow 114, that is opposite to the circumferential direction that the edges 96, 96', 96" face, as indicated by the arrow 98.

The finger 106 has a cantilevered construction with an attaching end 116 that is integral with the body 108. The finger 106 has a curved surface 118 that is concave opening radially inwardly substantially fully between the attaching end 116 and edge 112.

The edges 96, 96', 96" on the nut 20 face circumferentially towards, and reside in the paths of, the edges 112, 112', 112" on the sleeve/shield 24 as the sleeve/shield 24 is turned in the tightening direction, as indicated by the arrow 124. In a preferred form, the edges 112, 112', 112" are simultaneously brought into bearing engagement, each with one of the edges 96, 96', 96" on the nut 20, so that the nut 20 follows movement of the sleeve/shield 24 in the tightening direction around the axis 32. With the threads 22 on the nut 20 engaged with the threads on the port 14, this turning action causes a progressive engagement of the sets of threads 16, 22, thereby to eventually securely tighten the nut 20 to the port 14.

The sleeve/shield 24 has an outer surface 126 that is textured as by the provision of axial grooves 128 therearound to facilitate grasping and turning of the sleeve/shield by a hand of a user around the axis 32. The body 44 of the sleeve/shield 24 has an axial extent L sufficient to surround substantially the entire axial extent of the nut 20 and at least a majority of the axial extent of the fitting 18. With this configuration, the sleeve/shield 24 fully blocks radial movement of a conventional wrench into operative engagement with the nut 20 at the surface portion 102. By extending to cover the fitting 18, the sleeve/shield 24 also prevents access to the compression ring 30 that someone might obtain to separate the coaxial cable end 12. At the same time, the significant axial extent of the body 44 provides an enlarged gripping surface so that a substantial torque can be applied by the hand of a user grasping the outer surface 126 thereof.

For balanced and positive torque transmission between the sleeve/shield 24 and nut 20, it is preferred that each of the fingers 106, 106', 106" cooperates with one of the edges 96, 96', 96" and that there by simultaneous engagement of the multiple edges 96, 96', 96", 112, 112', 112". Further, each of the edges 96, 96', 96", 112, 112', 112" engages over a substantial axial extent to assure positive torque transmission.

The fingers 106, 106', 106" are reconfigurable in a manner whereby the sleeve/shield 24 is allowed to move continuously relative to the nut 20 around the central axis 32 in a loosening direction, that is opposite to the tightening direction, as indicated by the arrow 130. To allow this movement, each of the fingers 106, 106', 106" is reconfigurable primarily by bending radially outwardly. This bending is facilitated by strategic configuration of the outer surface portion 100 on the nut 20. Between adjacent edges 96, 96', 96", there is an outer surface extent 132 that increases progressively in diameter in a circumferential direction from each edge 96, 96', 96" towards the next adjacent edge 96, 96', 96". As seen most clearly in FIG. 6, the exemplary finger 106 is progressively cammed radially outwardly by the outer surface extent 132 as the exemplary edge 112 moves towards the exemplary edge 96 as the sleeve/shield 24 is moved in a loosening direction, indicated by the arrow 130. The exemplary finger 106 in FIG. 6 thus bends radially outwardly progressively as it moves up to the edge 96, and then bends radially inwardly under a restoring force to a position shown in dotted lines in FIG. 6 as the edge 112 clears the edge 96. This action repeats for each finger 106, 106', 106" as the sleeve/shield 24 is continuously turned in the loosening direction, indicated by the arrow 130.

Figure 5:
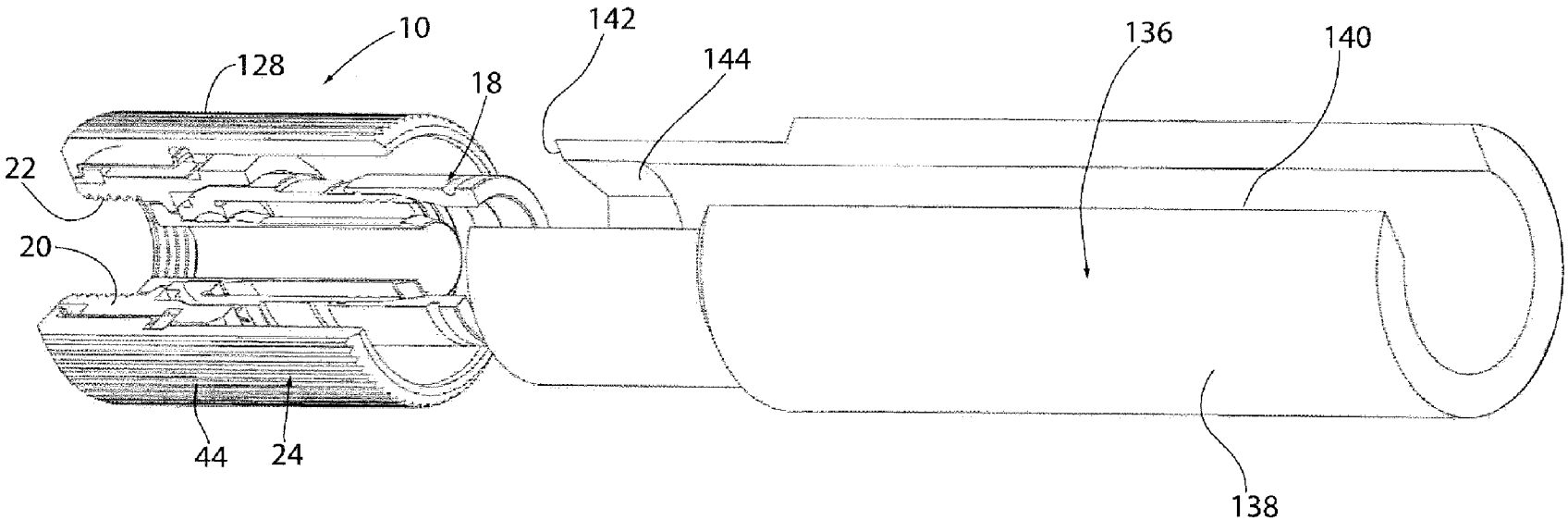
FIG. 5 is a perspective view of the connecting assembly as shown in FIG. 4 and in relationship to a tool that is usable to separate the connecting assembly from a port to which it is threadably connected.

In the event that it is desired to release the connecting assembly 10 from the port 14, a security tool is used, as shown at 136 in FIG. 5. The security tool 136 has a generally cylindrical body 138 with a lengthwise slot 140 that allows the tool 136 to be directed radially relative to the length of coaxial cable in the orientation shown to a concentric relationship with the coaxial cable.

At an operating end 142 of the tool 136, a radially inwardly facing surface 144 is configured to be complementary to the polygonal shape of the surface portion 102 of the nut 20. The tool 136 can be directed axially toward the connecting assembly 10 from an initial axially spaced position, shown in FIG. 5, to a position wherein the surface 144 makes keyed engagement with the nut 20 at the surface portion 102. The tool 136 can then be manipulated by grasping and turning the same to loosen the nut 20 from the port 14.

While a conventional polygonal shape is shown for the surface portion 102, it should be understood that, for security purposes, individual cooperating shapes may be devised for the surface portion 102 and tool 136, that are non-conventional and require a specialized tool.

In the above-described embodiment, the components making up the fitting 18 define a means for connecting the fitting 18 to an end of a coaxial cable. The edges 96, 96', 96" and 112, 112', 112", defined respectively on the nut 20 and sleeve/shield 24, are means that cooperate to: a) be brought into bearing engagement as the sleeve/shield 24 is turned in the tightening direction around the central axis 32 so that the nut 20 follows movement of the sleeve/shield 24 around the central axis 32; and b) allow the sleeve/shield 24 to be moved continuously relative to the nut 20 around the central axis 32 in a loosening direction that is opposite to the tightening direction.

Figure 7:
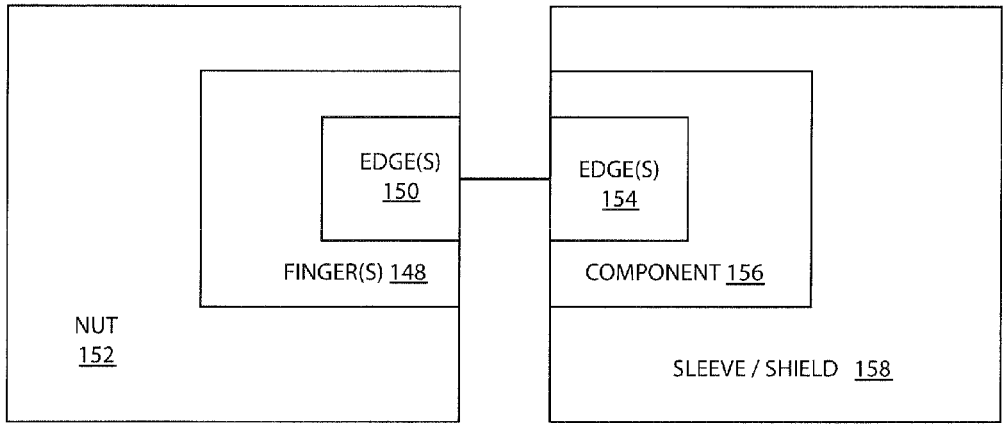
FIG. 7 is a schematic representation of the components shown in FIG. 6 and in a reversed orientation, wherein the fingers are on the nut.
Figures 2, 6:
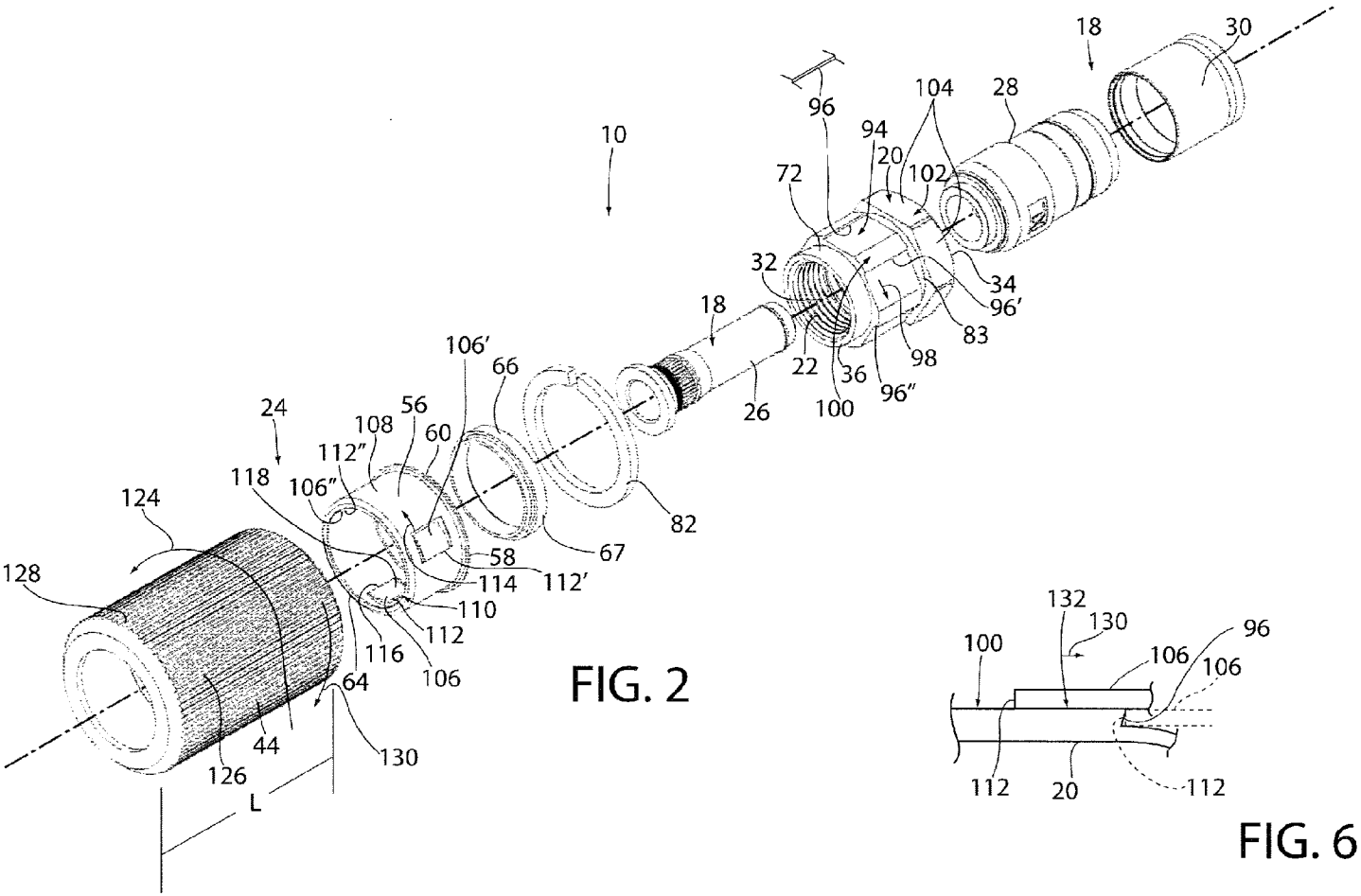
FIG. 2 is an exploded, perspective view of one specific form of connecting assembly, as shown in FIG. 1.
FIG. 6 is an axial, fragmentary view showing interaction of fingers on a sleeve/shield that interact with edges defined on a nut on the connecting assembly.
Figure 3:
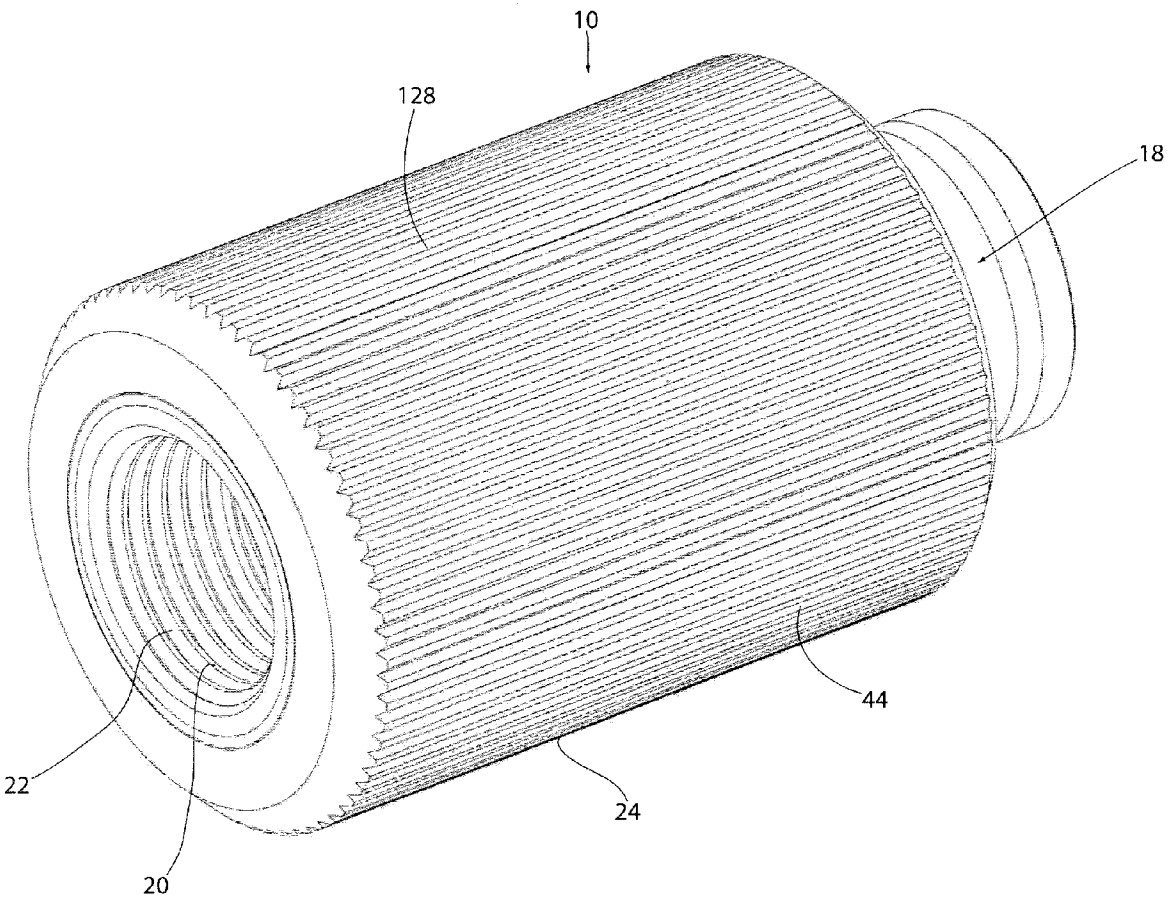
FIG. 3 is an enlarged, perspective view of the connecting assembly of FIG. 2 in an assembled state.
Figure 4:
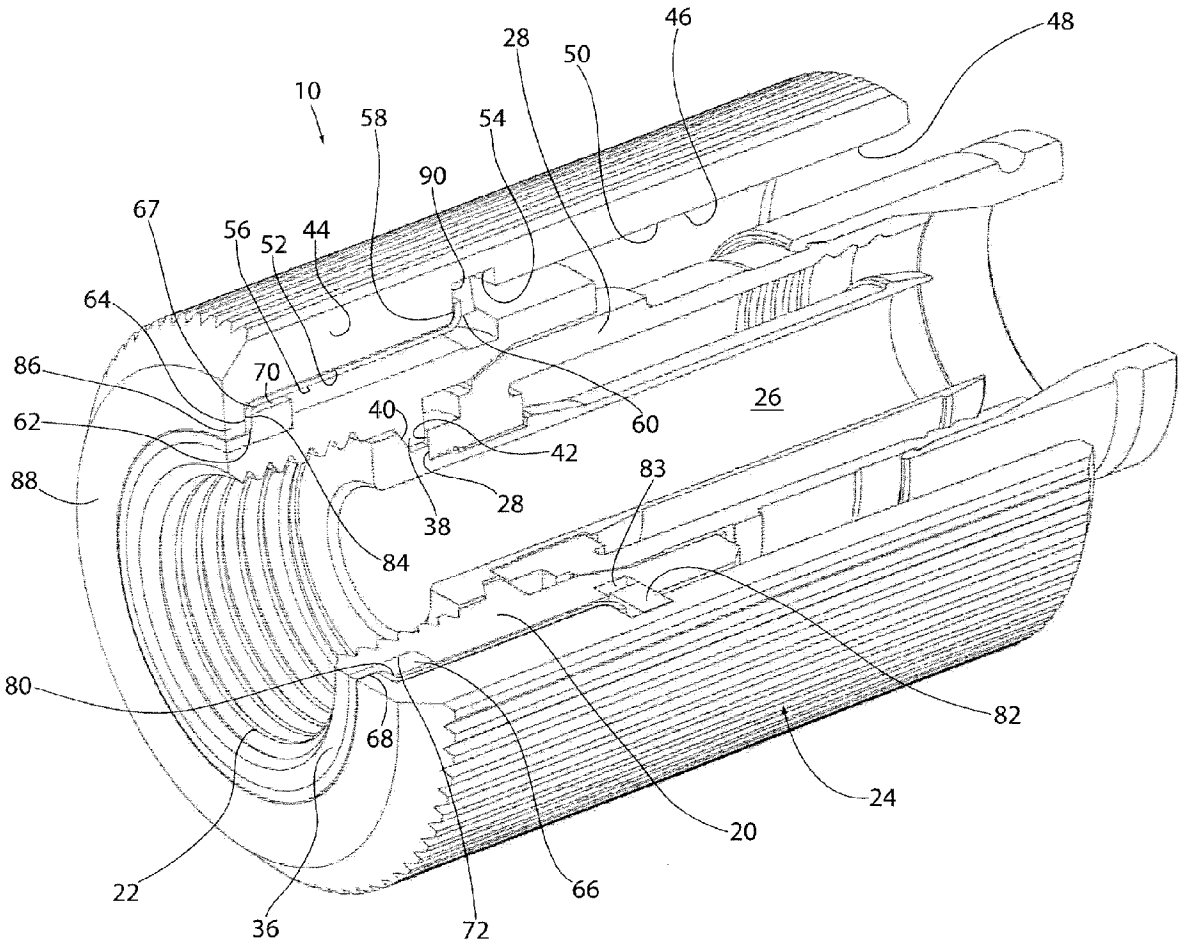
FIG. 4 is a view as in FIG. 3 wherein the connecting assembly is broken away to expose internal components thereof.

As shown for one variation in FIG. 7, the invention contemplates a reversal of components wherein at least one finger 148, corresponding to the finger 106, and having an edge 150, corresponding to the edge 112, might be provided on a nut 152, corresponding to the nut 20.

At least one edge 154, corresponding to the edge 96, can be provided on an annular component 156, corresponding to the component 56, on a sleeve/shield 158, corresponding to the sleeve/shield 24. The finger 148 may be reconfigurable to allow the aforementioned interaction of edges 150, 154 that allows only tightening of the nut 152 to the sleeve/shield 158.

It should also be noted that the fingers do not need to be cantilever mounted. Other configurations that would produce the required circumferentially facing edges and allow reconfiguration corresponding to that for the fingers 106, 106', 106", 148 are contemplated by the invention.

Figure 8:
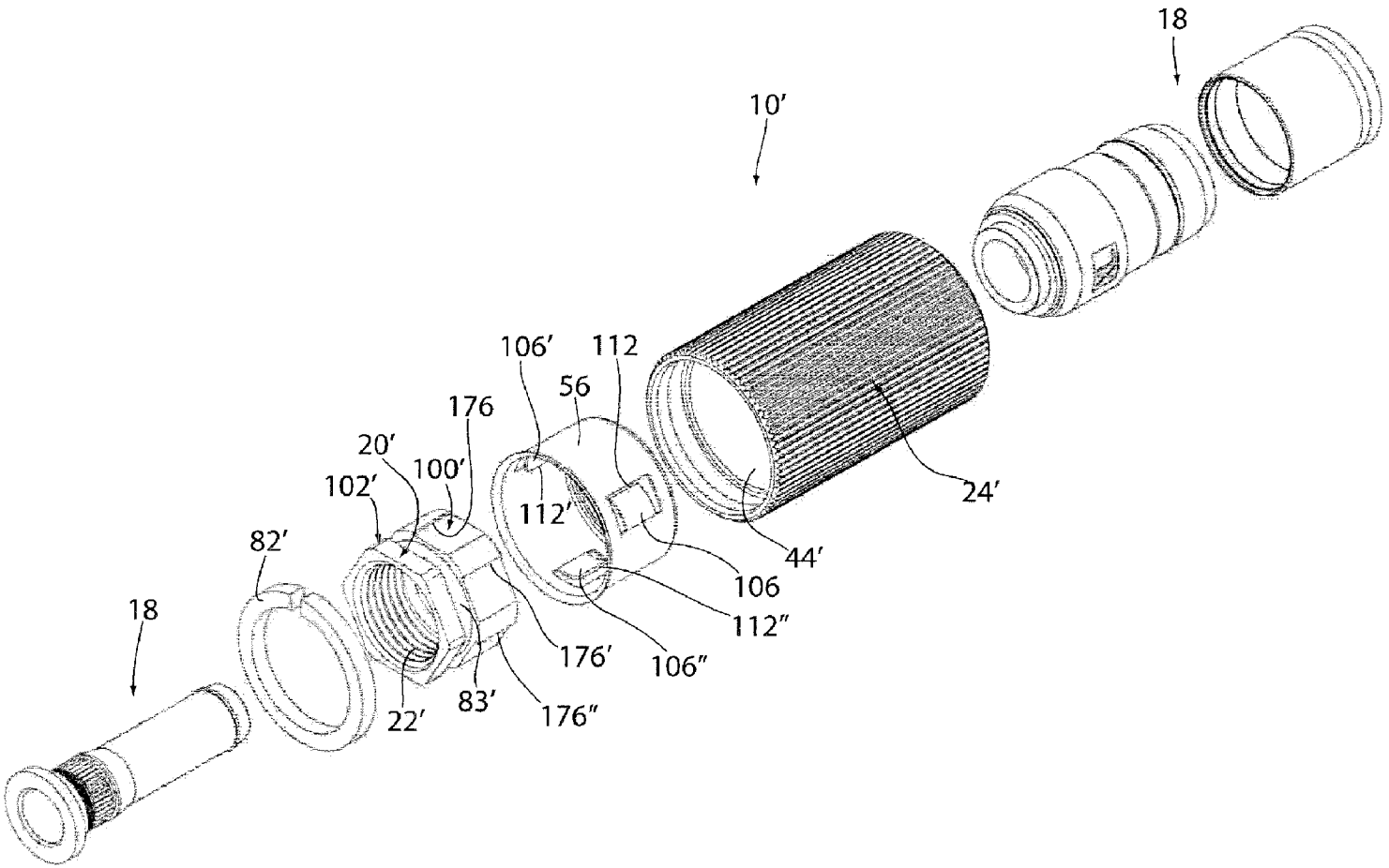
FIG. 8 is an exploded, perspective view of a modified form of connecting assembly, according to the invention.
Figure 9:
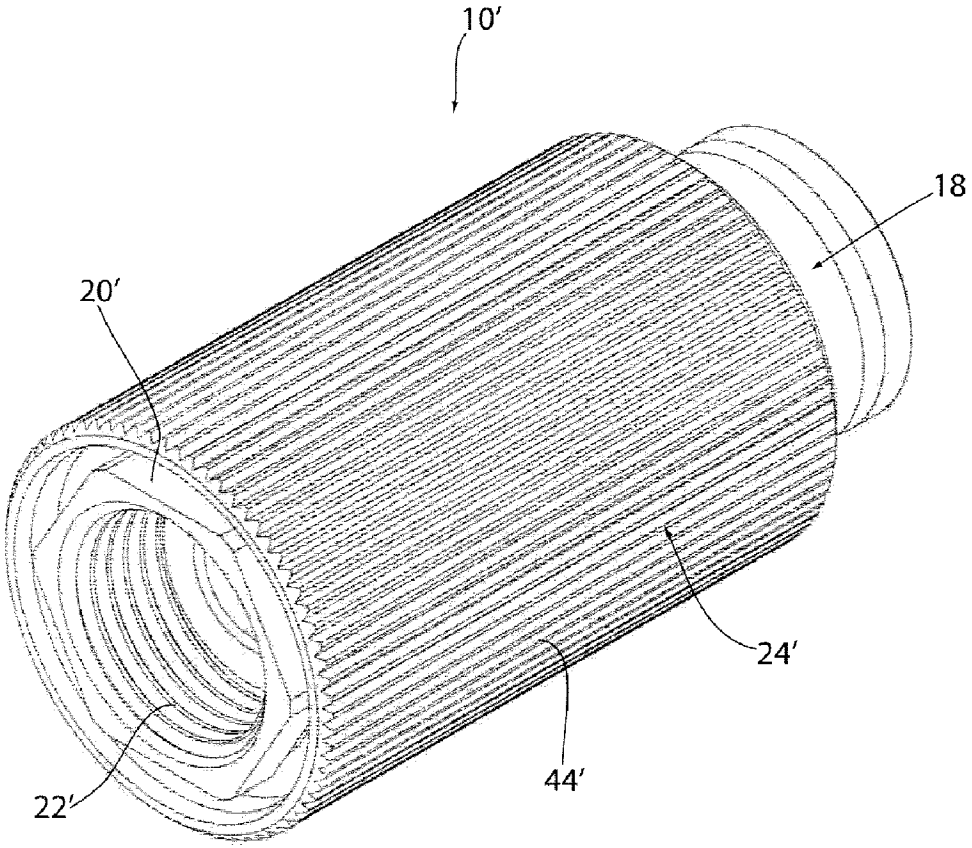
FIG. 9 is an enlarged, perspective view of the connecting assembly in FIG. 8 in an assembled state.
Figure 10:
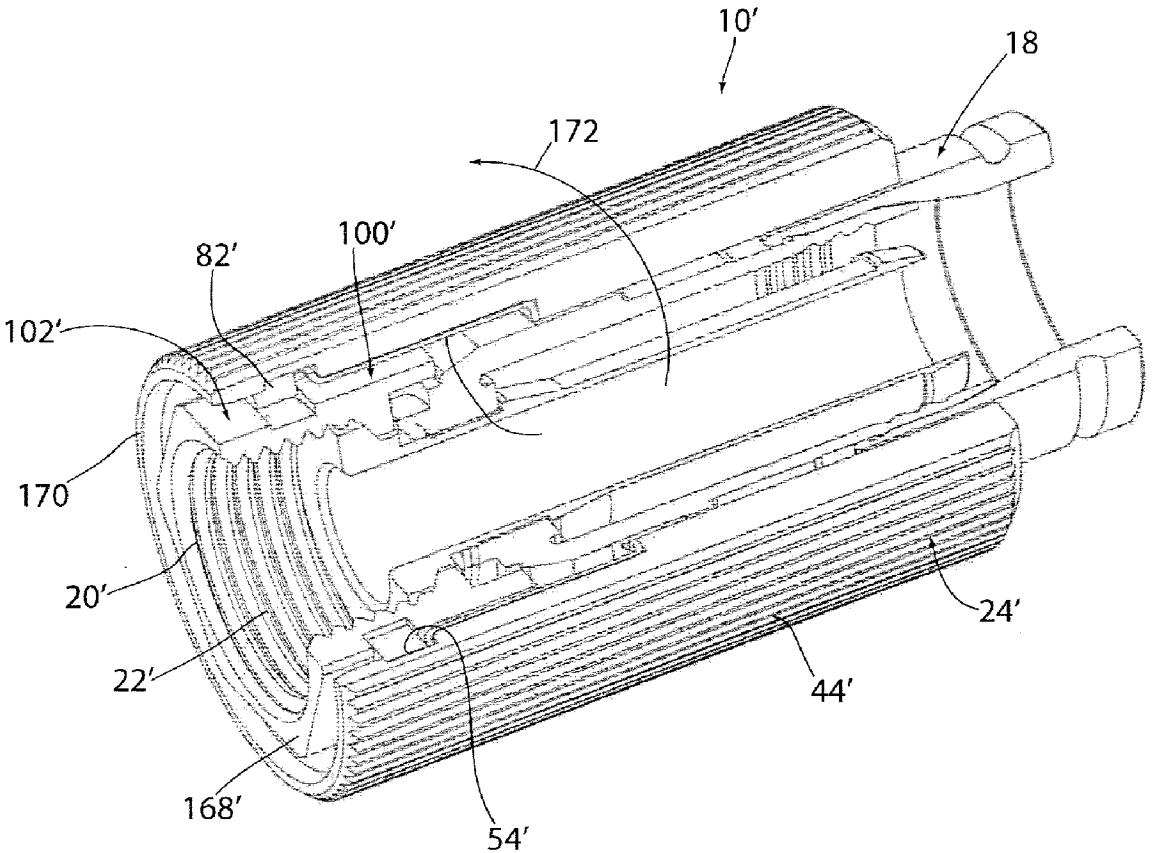
FIG. 10 is a view as in FIG. 9 wherein a portion of the connecting assembly is broken away to expose internal components thereof.

A further variation of the invention is shown in FIGS. 8-10. In these Figs., a connecting assembly is shown at 10' that operates in substantially the same manner as the connecting assembly 10, with one primary exception. Whereas the connecting assembly 10 is constructed so that the tool 136 must be directed from an initially axially spaced position towards an axial end of the connecting assembly 10 at which the fitting 18 is provided, with the connecting assembly 10, the corresponding tool 136 must be moved in an axially opposite direction from an initially axially spaced position to engage a corresponding nut 20'.

In this embodiment, the connecting assembly 10' has an identical fitting 18 and annular component 56 with fingers 106, 106', 106" thereon. The nut 20 has axially reversed outer surface portions 100', 102', with a locking groove 164 therebetween.

A split locking ring 82' fits within the locking groove 83' and an oppositely opening locking groove 54' in the body 44' of the sleeve/shield 24' to maintain the sleeve/shield 24', fitting 18 and nut 20' in assembled axial relationship wherein the nut end 168 is substantially flush with the axial end 170 of the body 44' of the sleeve/shield 24'.

The nut 20' has a set of threads 22' thereon that is engaged with the set of threads 16 on the port 14. By turning the sleeve/shield 24' in a tightening direction, as indicated by the arrow 172, the nut 22' is caused to follow this movement by reason of the above described interaction of the edges 112, 112', 112" on the sleeve/shield 24 and the edges 176, 176', 176" corresponding to the edges 96, 96', 96".

The foregoing disclosure of specific embodiments is intended to be illustrative of the broad concepts comprehended by the invention.

The invention claimed is:

1. An assembly for connecting a coaxial cable end to a threaded port, the connecting assembly comprising:

a fitting to which an end of a coaxial cable can be connected;

a nut joined to the fitting and having a first set of threads, the nut turnable in a tightening direction around a central axis of the connecting assembly to progressively engage the first set of threads with a second set of threads on a port, the nut having an outer surface at which a first edge, facing circumferentially in a first direction, is defined; and a sleeve surrounding the nut and comprising a body with a first reconfigurable finger extending in a circumferential direction and upon which a second edge, facing circumferentially in a second direction oppositely to the first direction, is defined, the second edge brought into bearing engagement with the first edge as the sleeve is turned in the tightening direction around the central axis so that the nut follows movement of the sleeve to secure the nut to a port, the sleeve movable continuously relative to the nut around the central axis in a loosening direction that is opposite to the tightening direction.

2. The connecting assembly according to claim 1 wherein the first finger is movable as one piece with the sleeve body.

3. The connecting assembly according to claim 2 wherein the first finger is struck from an annular component and projects in cantilever fashion to the second edge.

4. The connecting assembly according to claim 1 wherein the nut has first and second axially spaced surface portions, the first edge defined on the first surface portion, the second surface portion having a plurality of flats arranged to be operatively engaged by a conventional wrench through relative radial movement between the wrench and nut in such a manner that spaced surfaces on the wrench simultaneously engage at least two of the flats on the nut in a manner whereby the wrench can be manipulated to turn the nut around the central axis.

5. The connecting assembly according to claim 4 wherein the sleeve has an axial extent and is configured so that the sleeve blocks radial movement of a conventional wrench into operative engagement with the nut.

6. The connecting assembly according to claim 5 in combination with a tool that can be directed axially relative to the connecting assembly into keyed engagement with the nut, whereupon the tool can be manipulated to turn the nut around the central axis to release the nut from a port with which the nut is threadably engaged.

7. The connecting assembly according to claim 6 wherein the connecting assembly has axially spaced first and second ends, the fitting is at the first end of the connecting assembly, the nut is at the second end of the connecting assembly, and the tool is directed into keyed engagement with the nut by movement from an initial axial spaced position in an axial direction from the first end toward the second end.

8. The connecting assembly according to claim 6 wherein the connecting assembly has axially spaced first and second ends, the fitting is at the first end of the connecting assembly, the nut is at the second end of the connecting assembly, and the tool is directed into keyed engagement with the nut by movement from an initial axially spaced position in an axial direction from the second end toward the first end.

9. The connecting assembly according to claim 1 wherein the first and second edges engage over a substantial axial extent so that there is positive torque transmission effected by the sleeve from the second edge to the nut through the first edge.

10. The connecting assembly according to claim 1 wherein there is at least one other edge on the nut that is circumferentially spaced from the first edge and cooperates with the second edge in a manner that is substantially the same as a manner in which the first edge cooperates with the second edge.

11. The connecting assembly according to claim 1 wherein there is at least one other reconfigurable finger on the sleeve that is circumferentially spaced from the first finger and cooperates with the first edge in a manner that is substantially the same as a manner in which the first finger cooperates with the first edge.

12. The connecting assembly according to claim 1 wherein the sleeve has an outer surface that is textured to facilitate grasping and turning of the sleeve by a hand of a user.

13. The connecting assembly according to claim 1 wherein the nut has an outer surface extent that increases in diameter in a circumferential direction progressively toward the first edge so that the first finger is progressively cammed radially outwardly by the outer surface extent as the second edge circumferentially approaches the first edge as the sleeve is moved relative to the nut in the loosening direction.

14. The connecting assembly according to claim 1 wherein the first finger has a cantilevered configuration and is reconfigured primarily by bending in a radial direction as the second edge moves circumferentially up to and past the first edge as the sleeve is moved relative to the nut in the loosening direction.

15. The connecting assembly according to claim 14 wherein the first finger has an attaching end and a curved surface that is concave opening radially inwardly substantially fully between the attaching end and second edge.

16. The connecting assembly according to claim 1 wherein the sleeve has an axial extent sufficient to surround substantially an entire axial extent of the nut and at least a majority of an axial extent of the fitting.

17. An assembly for connecting a coaxial cable end to a threaded port, the connecting assembly comprising:

fitting means for connection to an end of a coaxial cable;

a threaded nut joined to the fitting means and turnable in a tightening direction around a central axis of the connecting assembly to progressively threadably engage the nut with a port;

a sleeve surrounding the nut; and a first edge means on the nut and a second edge means on the sleeve cooperating to: a) be brought into bearing engagement as the sleeve is turned in the tightening direction around the central axis so that the nut follows movement of the sleeve around the central axis; and b) allow the sleeve to be moved continuously relative to the nut around the central axis in a loosening direction that is opposite to the tightening direction.

18. The connecting assembly according to claim 17 wherein the sleeve has an axial extent and is configured so that the sleeve blocks radial movement of a conventional wrench into operative engagement with the nut.

19. The connecting assembly according to claim 18 in combination with a tool that can be directed axially relative to the connecting assembly into keyed engagement with the nut, whereupon the tool can be manipulated to turn the nut around the central axis to release the nut from a port with which the nut is threadably engaged.

20. A method of connecting a coaxial cable end to a threaded port, the method comprising the steps of:

providing a connecting assembly with a central axis and comprising a fitting, a threaded nut joined to the fitting and having a first circumferentially facing edge, and a sleeve surrounding the nut and at least a part of the fitting and defining a second circumferentially facing edge, one of the edges defined by a finger that extends circumferentially and is reconfigurable to vary a radial position of the one edge;

connecting the coaxial cable end to the fitting;

mating threads on the nut with threads on the port; and turning the sleeve in a tightening direction around the central axis and thereby causing the edges to interact so that: a) the second edge bears against the first edge to thereby cause the nut to follow movement of the sleeve around the central axis; and b) the second edge can move past the first edge in the event the sleeve is turned continuously around the central axis in a loosening direction that is opposite to the tightening direction.

21. The connecting method according to claim 20 wherein the step of providing a connecting assembly comprises providing a connecting assembly with the sleeve that has an axial extent sufficient to surround substantially an entire axial extent of the nut and at least a majority of an axial extent of the fitting.

22. The connecting method according to claim 21 further comprising the steps of providing a tool and directing the tool from an initial axial spaced position in an axial direction into keyed engagement with the nut, and through manipulation of the tool effecting turning of the nut around the central axis in a loosening direction.

* * * * *